US005802998A

United States Patent [19]

Ciucani

[11] Patent Number: 5,802,998

[45] Date of Patent: Sep. 8, 1998

[54] AUTOMATIC SEWING MACHINE FOR VARIOUS ARTICLES, IN PARTICULAR LEATHER ARTICLES

[76] Inventor: Mario Ciucani, Via S. Girolamo, Fermo (Ascoli Piceno), Italy

[21] Appl. No.: 849,027

[22] PCT Filed: Nov. 30, 1995

[86] PCT No.: PCT/IB95/01082

§ 371 Date: May 27, 1997

§ 102(e) Date: May 27, 1997

[87] PCT Pub. No.: WO96/17989

PCT Pub. Date: Jun. 13, 1996

[30] Foreign Application Priority Data

Dec. 6, 1994 [IT] Italy ..... B0940206 U

[51] Int. Cl.[6] ..... D05B 15/02; D05B 27/20; D05B 35/10

[52] U.S. Cl. ..... 112/49; 112/62; 112/310; 112/153; 112/321

[58] Field of Search ..... 112/28, 47, 49, 112/62, 63, 136, 153, 310, 321, 235, 37

[56] References Cited

U.S. PATENT DOCUMENTS 1,617,338 2/1927 Leveque .
3,038,428 6/1962 Judet ..... 112/37
4,375,787 3/1983 Brutti ..... 112/28
4,848,252 7/1989 Ciucani .
5,257,589 11/1993 Forstpointner ..... 112/28

*Primary Examiner*—Peter Nerbun
*Attorney, Agent, or Firm*—McAulay Fisher Nissen Goldberg & Kiel, LLP

[57] ABSTRACT

A machine includes a fixed guide (3) which longitudinally defines two work tops (P1 ,P2), the work tops supporting and guiding the edges (30*a*,40*a*) of leather articles (30,40) to be sewn together. As it moves following an arcuate path, the needle pierces the edges (30*a*,40*a*), located on the work tops (P1,P2). After a stitch is made, the needle and a rotating crochet (19) are shifted toward the machine structure, making the two edges of the leather articles move one step forward. After having left the edges of the leather articles (30,40), located on the work tops (P1,P2), the needle and the rotating crochet (19) rise and are shifted in the opposite direction up to their starting position. Two presser feet (15*a*,15*b*), situated beside the two work tops, at the back of the needle (14), press the edges of the leather articles (30,40), when the needle pierces them.

8 Claims, 5 Drawing Sheets

AUTOMATIC SEWING MACHINE FOR VARIOUS ARTICLES, IN PARTICULAR LEATHER ARTICLES

TECHNICAL FIELD

The present invention relates to machines for footwear production.

BACKGROUND ART

The Applicant has already constructed machines for sewing leather, e.g. toe caps and uppers that form a kind of shoe called a moccasin (see Italian Patent No. 1.192.031).

This known machine is extremely versatile and particularly suitable for producing the so called tubular moccasins.

As it is known, this type of moccasin includes a close-bottomed upper. During manufacturing, the edge of the upper and the edge of the toe cap are placed on upwardly convergent work tops, close to each other, and sewn together.

The just mentioned machine includes a feed dog, situated beside the first work top, and reciprocating longitudinally in phase relation with the movement of the needle and a first presser foot, but in the opposite direction.

When the edges of the leather articles are being sewn, the feed dog crimps the edge of the upper so as to allow shaping of the moccasin.

The tubular moccasin, obtained in this way, partially covers the support arm of the sewing equipment that must have a suitable shape so as not to interfere with the operator's movements and the shoe making parts.

The necessity exists of a machine that features the same quality as the machine briefly described above, but that is simpler under the manufacturing point of view and that is particularly suitable for sewing moccasins only with an open-bottomed upper.

DISCLOSURE OF THE INVENTION

The object of the present invention is to propose an automatic machine for sewing leather that meets the above mentioned necessity, i.e. a machine of simple construction, easy to use, reliable and functional.

Another object of the present invention is to make it possible to use the machine in its simplified form, even with a rectilinear needle.

The above mentioned objects are obtained, in accordance with the claims, by means of an automatic machine for sewing different kinds of articles, especially leather articles such as an upper and a toe cap for producing a so-called open moccasin, that includes: a longitudinal guide that is removably mounted on an underlying fixed support and that defines two longitudinal work tops, first and second, respectively formed by flat sloping surfaces mutually and upwardly convergent; hold down means that are located above said guide and that, in conjunction with said work tops, guide the edges of articles resting on said work tops; a needle situated beside the second work top, and movable so as to define two extreme positions, in one of which the said needle pierces juxtaposed edges of the articles resting on the above mentioned work tops, by passing through a slot made in the upper part of said work tops, said needle being also given a reciprocating longitudinal motion with an outward and return stroke, so as to make the leather articles move forward; a rotary hook device, located beside the first work top and working in conjunction with said needle to sew a stitch when the needle is in its lowermost position, in which it pierces the leather articles, said rotary hook device being also reciprocated, together with the needle.

BRIEF DESCRIPTION OF THE DRAWINGS

The invention can be fully understood from the following detailed description thereof, in connection with accompanying drawings which form a part of this application and in which.

BEST MODE OF CARRYING OUT THE INVENTION

Figure 1:
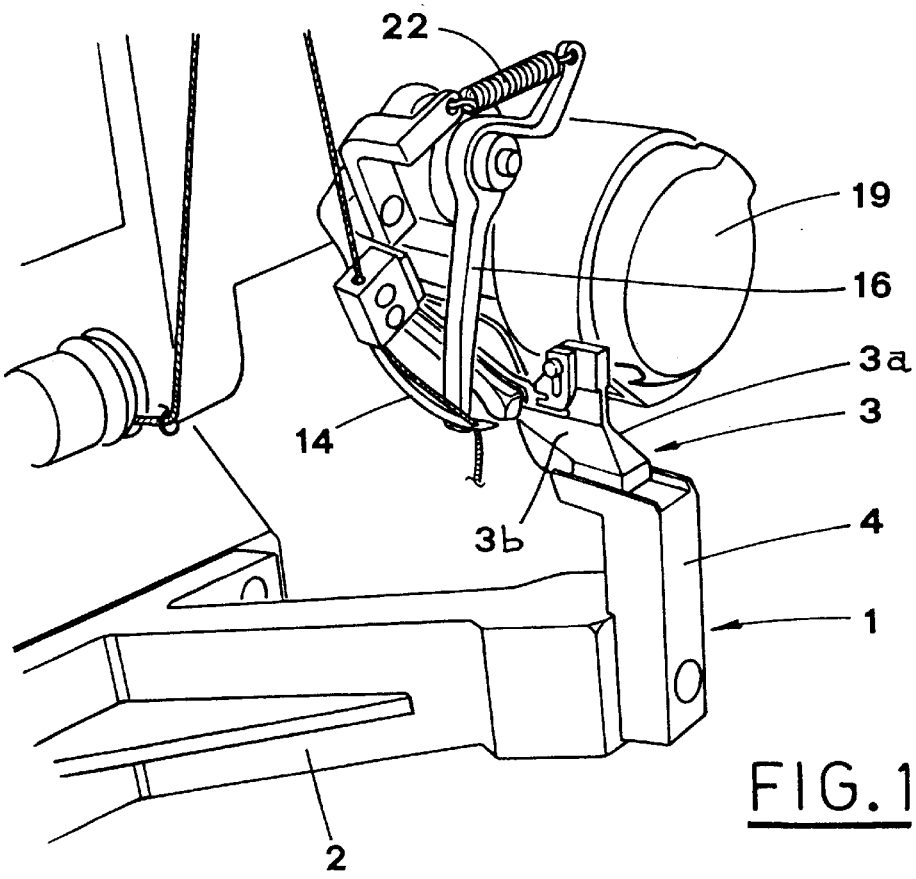
FIGS. 1, 2 are perspective views of the working zone of the subject machine.
Figure 2:
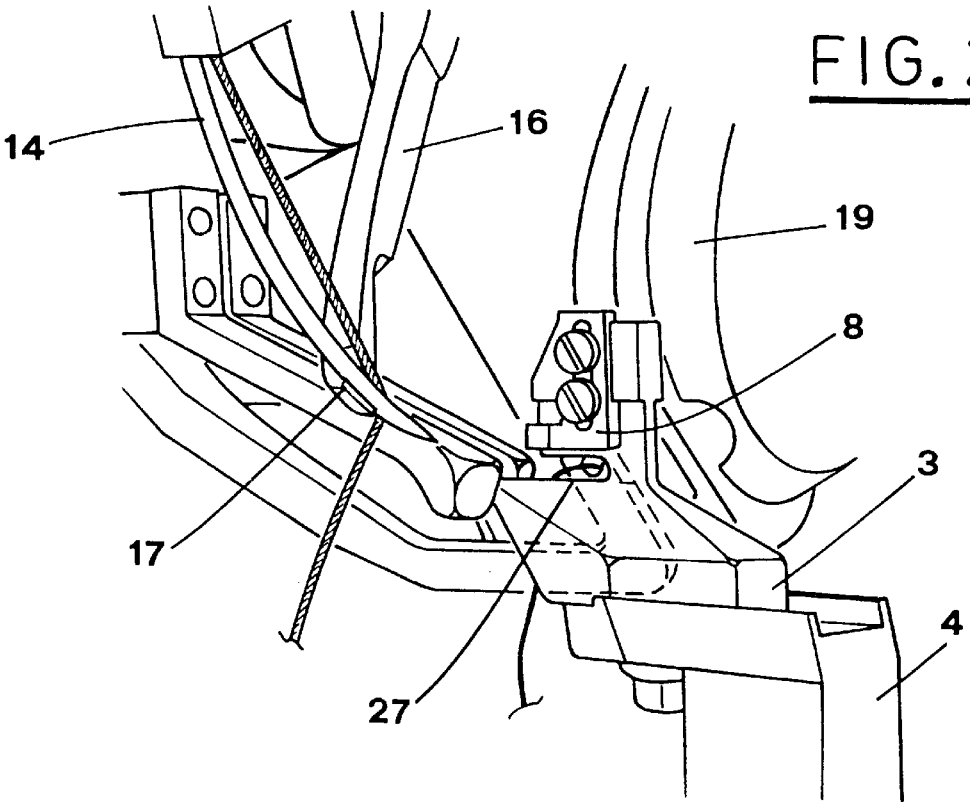
Figure 4:
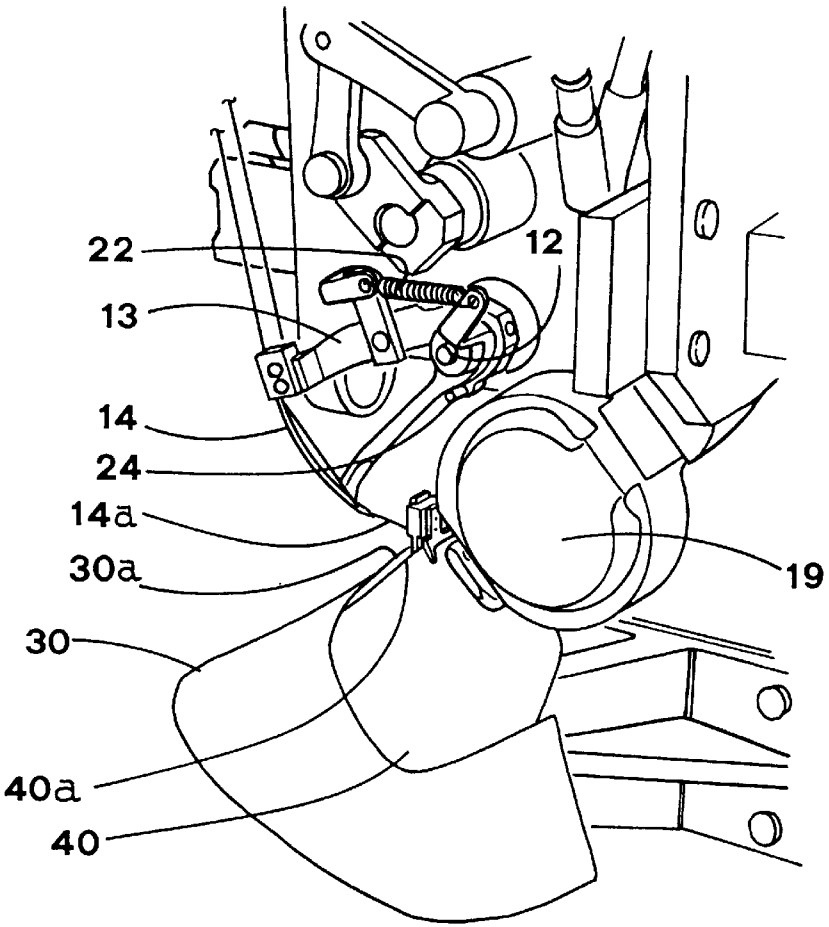
FIG. 4 is a perspective view of the machine working zone with the leather edges in sewing position.
Figure 3:
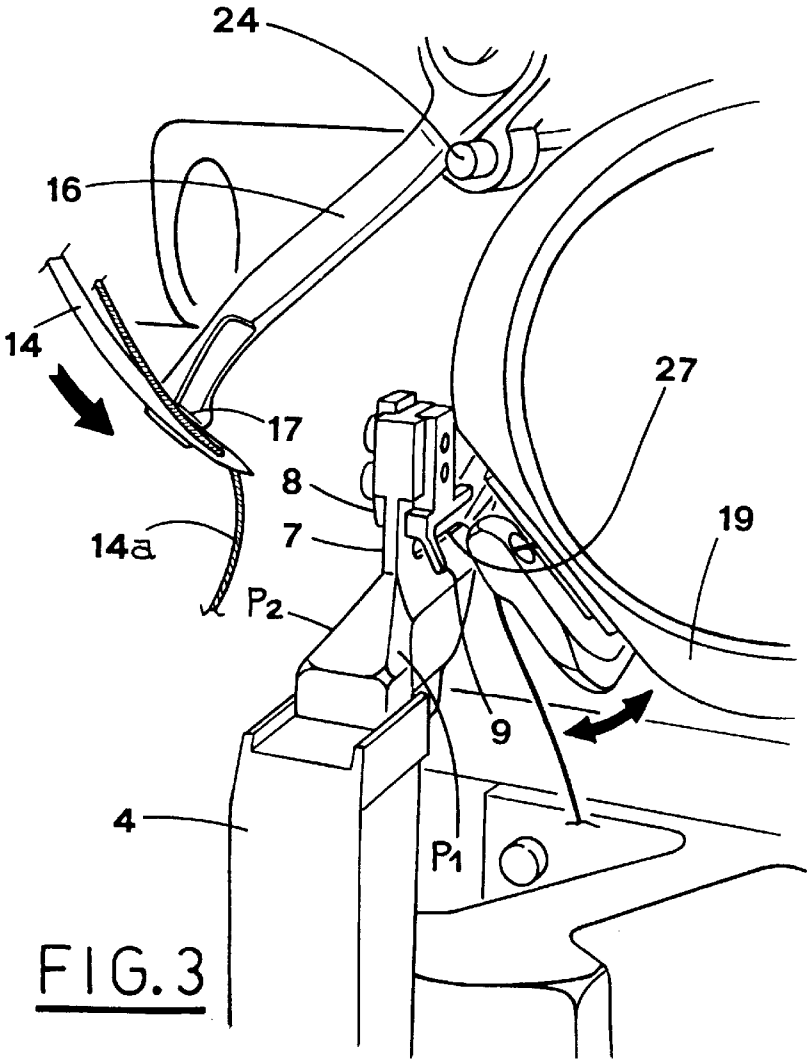
FIG. 3 is a perspective view of the working zone of the subject machine, seen from a different point of view.

With reference to the above mentioned Figures, the reference number 1 indicates a stationary support (that is an integral part of the machine support frame), on which a longitudinal guide 3 is removably fastened.

In particular, the stationary support 1 is formed by an arm 2, extending from the machine support frame, and a prismatic element 4, that is fastened to the arm 2. The vertical position of the prismatic element can be adjusted with respect to the arm 2.

The prismatic element 4 holds the guide 3, and the horizontal position of the guide 3 can be changed with respect to the prismatic element.

These adjustment possibilities allow the guide 3 to be suitably positioned with respect to the needle.

The sides of the guide 3 are formed by corresponding flat sloping surfaces 3*a*, 3*b*, mutually and upwardly convergent, that form longitudinal work tops P1, P2, on opposite sides, first and second work tops, respectively.

Over the guide 3, there are hold down means 8,9, cooperating with the work tops P1, P2 in guiding the edges 30*a*, 40*a* of the articles 30, 40 that rest on the same work tops P1, P2.

The hold down means 8, 9 are fastened to a small fin 7 that is integral with the guide 3. The hold down means 8 is formed by a blunted plate, and the blunting faces the work top P2. The hold down means 9 includes a protrusion of the fin 7, nearly parallel to the correspondent work top P1.

The curved needle 14, with thread 14*a*, is mounted on an arm 13 that has a length equal to the radius of the curvature of the needle and is situated on the side of the second work top P2.

The arm 13 is keyed onto a longitudinal shaft 12, that is made to oscillate with rotary motion in such a manner as to define the needle lowermost and uppermost positions, respectively raised and lowered.

The arm 13 performs also axial back and forth motion, so that the needle 14 reciprocates in directions parallel to the work tops P1,P2.

In its lowered position, the needle pierces the juxtaposed edges 30*a*,40*a* of the articles 30,40 located on work tops P1, P2, passing through a slot 27 made in the upper part of the work tops P1,P2.

Beside the second work top P2, there is a needle protecting element 16, rotatably mounted to the shaft 12, and connected to the arm 13 by elastic means 22 constituted by a spring.

The element 16 is pulled by the needle 14, during its downward movement, until it touches the edge 30 of the articles placed on the second work top P2.

In its lower end, the element 16 features a hollow 17 through which the needle 14 passes.

The element 16 remains in this position until the needle has left the edges of the articles 30,40, located on the work tops P1,P2, and then, while going upwards, the needle picks it up with a stopping means 24 and brings it back to the raised position.

Two presser feet 15*a*,15*b* are located on opposite sides of the two work tops P1,P2 and are made to reciprocate so as to act, in predetermined time, on the edges 30*a*,40*a* of the articles situated on the rear part of the work tops.

The presser feet keep pressed the edges 30*a*,40*a* of the leather articles 30,40 when the needle passes through and goes out of them.

A crochet 19, also known as rotary hook device, with a not shown bobbin of thread, is situated at the side of the first work top P1, and cooperates with the needle 14 when it is in its lowermost position, to make the stitches.

Figure 5:
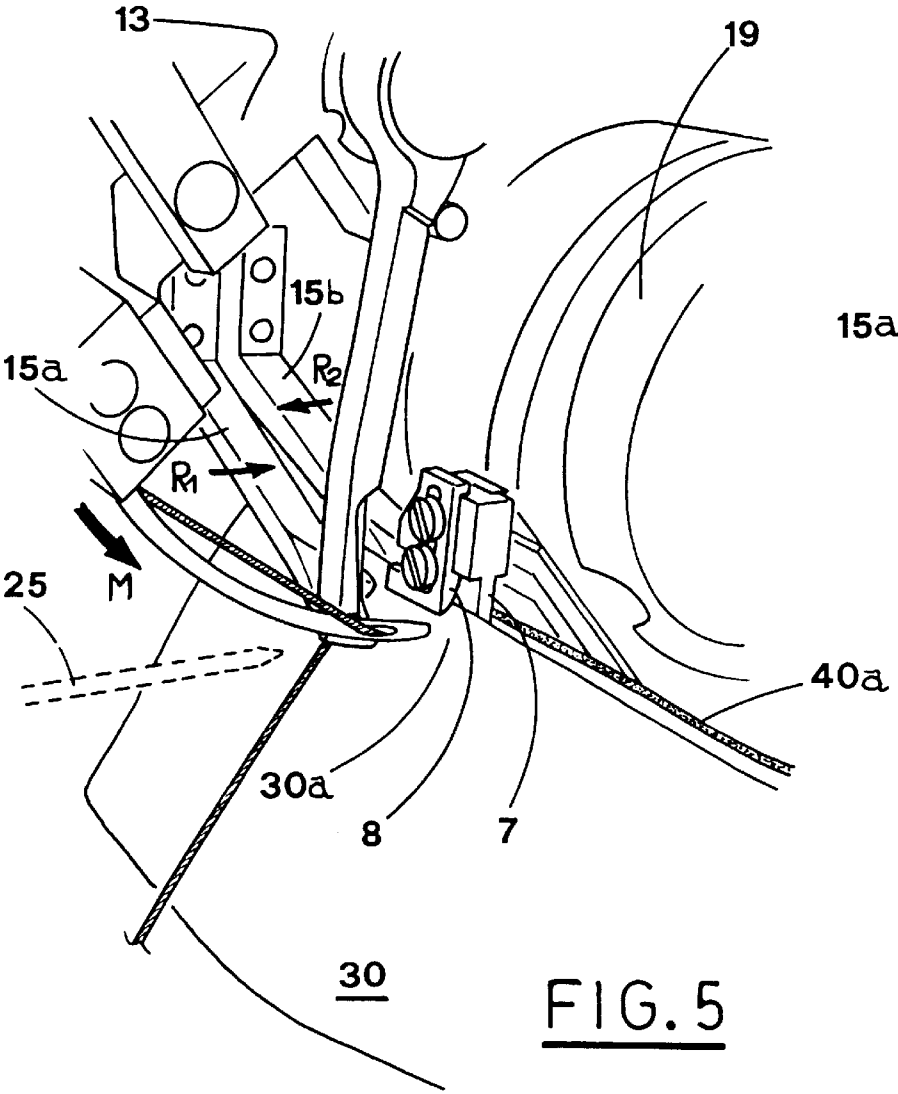

As shown in FIG. 5, while the protection element 16 is in the idle position, the needle 14 (in raised position) is moved in to the direction indicated by the arrow M, thus beginning its descending stroke.

At the same time, due to their motion according to the arrows R1 and R2, the presser feet 15*a*,15*b* clamp the edges 30*a*,40*a* of the leather articles.

Figure 6:
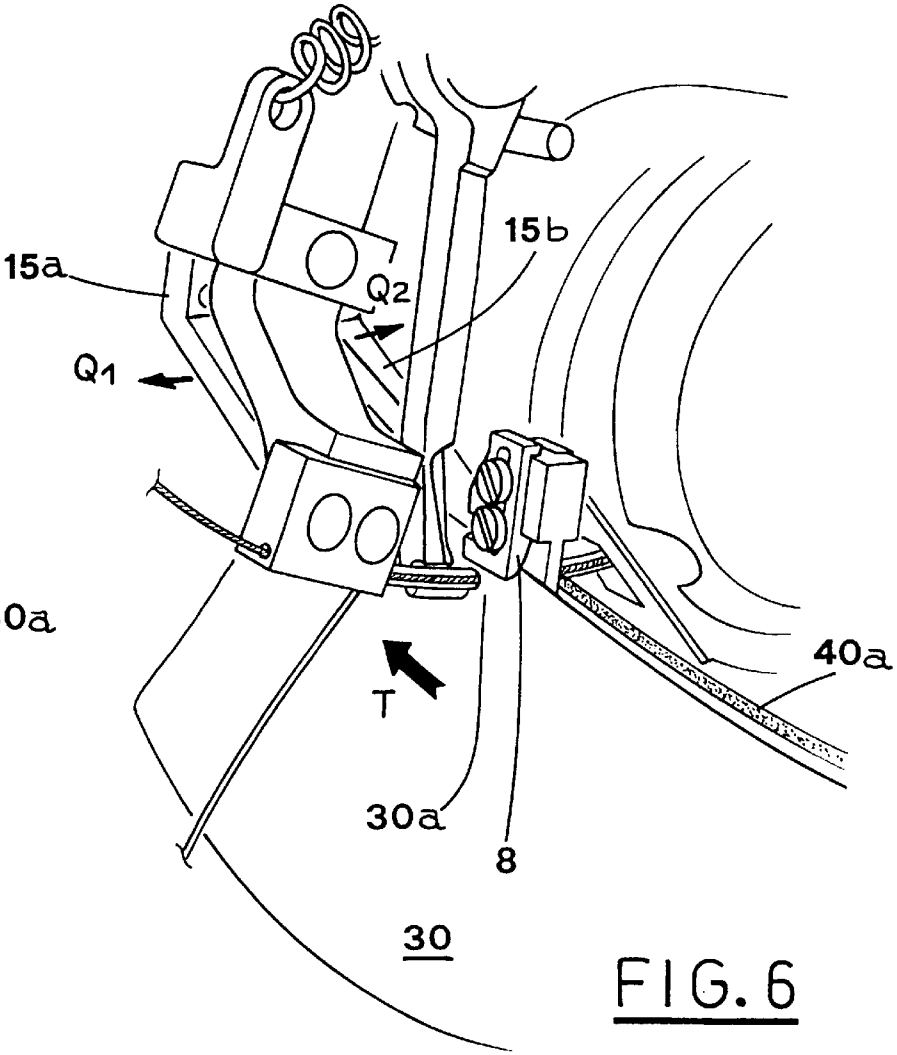
FIGS. 5, 6 and 7 are prospective views of the machine working zone, during three subsequent sewing steps.

After having reached the descent lowermost point (see FIG. 6), the needle pierces the edges of the articles 30,40 and drives the protection element 16, by the spring 22, to the working position, in which the said element 16 contacts the piercing zone, so as to protect the needle 14.

Afterwards, the presser feet 15*a*,15*b* are moved in opposite directions Q1 and Q2, thus being opened, and subsequently, the needle together with the crochet 19 translate in direction T, toward the machine support frame.

Due to these movements, the leather articles 30,40 are moved one step forward.

Figure 7:
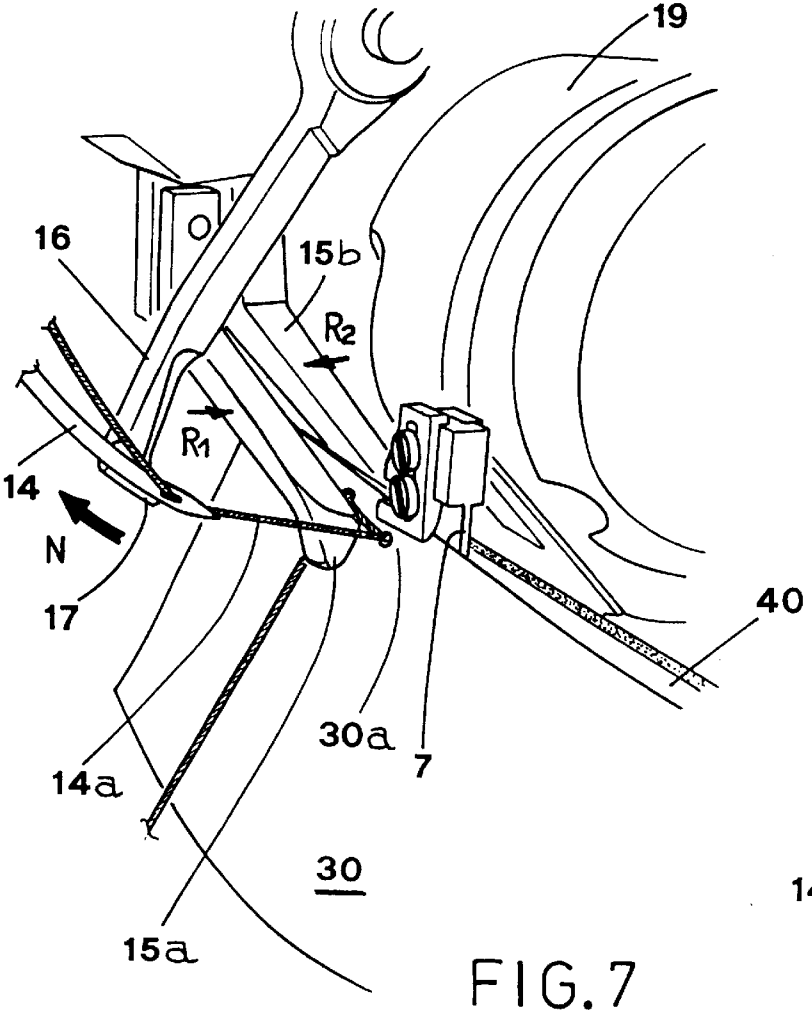

FIG. 7 shows the next step, in which the pressure feet are moved in opposite directions R1,R2, thus clamping the edges 30*a*,40*a*, while the needle moves in direction N to its raised position.

Finally, the needle 14 and the crochet 19 are moved away from the machine frame, brought back to their initial position, so that a new sewing cycle can begin.

Figure 8:
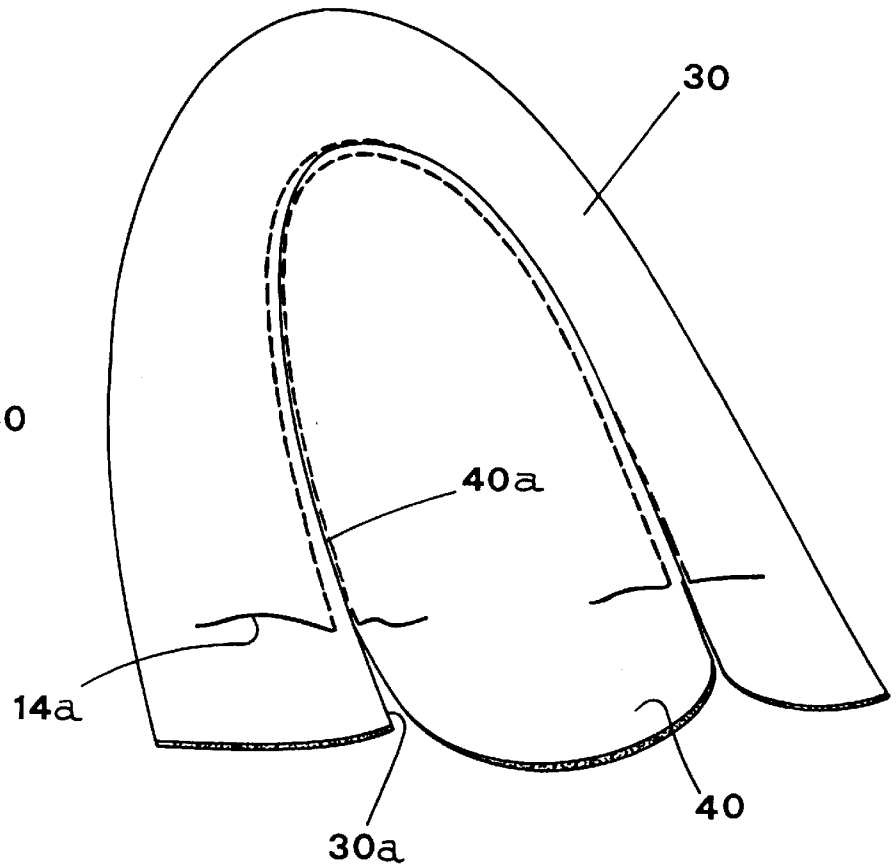
FIG. 8 shows the toe cap and the upper, sewn one to the other.

FIG. 8 shows the final effect of sewing the toe cap 40 to the upper 30, in order to form an open-bottomed moccasin.

Since only this type of footwear is to be sewn, the machine can be simplified in the above described way, because the upper of an open-bottomed moccasin does not have to be crimped in order to follow the toe cap shape during the stitching step.

As an alternative, the particular shape of the guide 3 and of the hold down means 8 and 9 allows the use of a straight needle instead of the conventional curved needle.

A straight needle 25, in a position suitable for its best working, is shown with a broken line in FIG. 5. Obviously, the straight needle 25 will be moved by other means, different from the shaft 12 operating the curved needle.

The fact that the upper of an open moccasin remains almost flat, as shown in FIG. 8, even after the toe cap has been sewn thereto, allows a simpler arm to be mounted with respect to the more versatile version of the machine described in the previous Italian Patent, mentioned in the introductory note.

The pitch of the stitch (i.e. the length of the stroke of the needle and crochet) can be adjusted, in known way, by using the means that act on the drive of the needle 14 and crochet 19.

The present machine, although in a simplified version, allows the same advantages to be obtained as by the machine disclosed and claimed in the Italian Pat. No. 1.192.031, nevertheless limited to sewing toe caps and uppers for open moccasins.

In particular, the machine is equipped with two work tops P1 and P2; this makes it possible to orienting the edges 30*a* and 40*a* in any way desired, and the orientation is defined by the slope of the surfaces 3*a*,3*b* in relation to each other.

Figure 9:
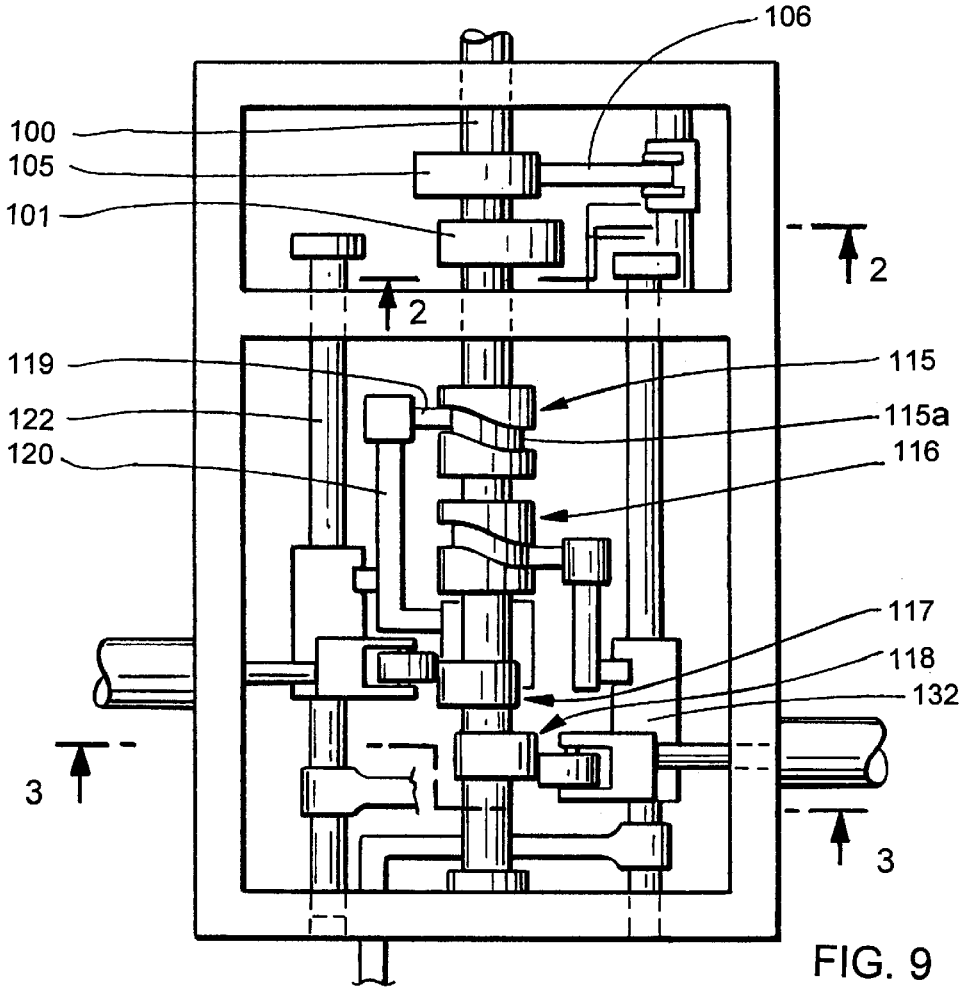
FIG. 9 PRIOR ART
FIG. 9 is a view of a prior art mechanism for operating the needle, a crochet, a first feed dog and a first pressure foot.
Figure 10:
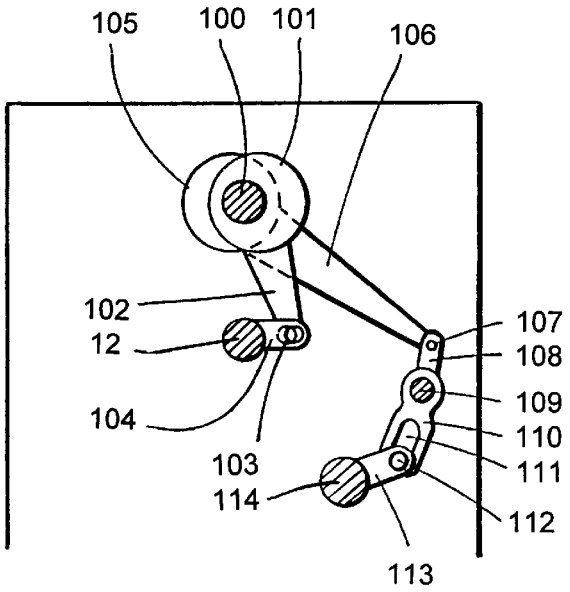
FIG. 10 PRIOR ART
FIG. 10 is a cross-section view taken along the line II—II of FIG. 9.

Referring to FIGS. 9 and 10, a primary shaft 100 is driven by known means, not illustrated, so that the shaft rotates constantly. A first eccentric 101 is keyed to the shaft 100, and a first connecting rod 102 is mounted on this eccentric as an integral part of it, a free end 103 of this first connecting rod being hinged to an arm 104 that is keyed to the shaft 12 (FIG. 10). The arm 13 to which the needle 14 is fitted is keyed to this latter shaft, as stated previously. The first eccentric 101 first connecting rod 102 assembly operates in conjunction with the arm 104 to make the shaft 12 oscillate, so that the needle 14 also oscillates, as described previously in directions M and N.

A second eccentric 105 is keyed to the shaft 100, and a second connecting rod 106 is mounted on this eccentric as an integral part of it, a free end 107 of this second connecting rod being hinged to an arm 108 that is keyed to an intermediate shaft 109. The second eccentric 105-second connecting rod 106 assembly operates in conjunction with the arm 108 to make the intermediate shaft 109 oscillate.

A fork 110 is keyed to the intermediate shaft 109, with the fork including a throat 111. A pin 112, which is an integral part of an arm 113 which is keyed to a shaft 114 (FIG. 9), engages in the throat 111 of the fork 110. The oscillation of the intermediate shaft 109 drives the fork 110, pin 112 and arm 113 assembly to cause the shaft 114 to oscillate.

The crochet 19 and bobbin of thread are connected to the shaft 114. Consequently, the crochet 19 and the bobbin oscillate in synchrony with the oscillation of the needle 14.

The first and second axial cams 115, 116 respectively, and first and second radial cams 117, 118, respectively, are keyed to the shaft 100 (FIG. 9). A pin 119, which is an integral part of a first arm 120 engages in a groove 15*a* of the first axial cam 115. This arm is an integral part of a sleeve 121 that is keyed to the above-mentioned shaft 12 (FIG. 9).

The fact that the pin 119 is engaged in the groove 115*a* means that the rotation of the shaft 100 causes the arm 120 to swing on an axis parallel to shaft 100, thus also causing the shaft 12 to oscillate on its axis, and the needle 14 to oscillate on its axis with it. This produces the stroke towards the machine support frame (direction T) and return stroke away from the frame (in direction opposite to T) referred to previously. The needle 14 is thus moved with an oscillating rotary movement and oscillating axial translating movement, with these movements effected in synchrony with one another as well as in relation to the oscillating rotary movement of the crochet 19.

This is only one possible configuration, given as an example, and it would be obvious to those skilled in the art that many other configurations can be employed without departing from the spirit of the invention.

It is understood that the description supplied herein is solely an unlimited example such that possible variations in the construction details will not affect the protective scope afforded to the invention as claimed hereinafter.

I claim:

1. An automatic machine for sewing different kinds of articles, especially leather articles such as an upper and a toe cap for producing an open moccasin, the machine comprising:

a machine support frame having a fixed support (1) fastened thereto;

a longitudinal guide (3) that is removably mounted on the fixed support;

flat slopping surfaces **(3*a*, 3*b*) made mutually and upwardly convergent on said longitudinal guide to define first and second longitudinal work tops (P1, P2) respectively, a longitudinal slot (27)** made in an upper part of the sloping surfaces;

hold down means (8, 9) located above the guide which in conjunction with the work tops guide juxtaposed edges **(30*a*, 40*a*) of the articles (30, 40)** placed on the work tops;

a needle (14, 25) situated beside the second work top (P2) and movable so as to define two extreme positions, a first lowermost position in which said needle pierces the juxtaposed edges of the articles resting on the work tops, the first position reached by the needle passing through the slot of the work tops, and a second raised position in which said needle is extracted from the juxtaposed edges of the articles;

a rotary hook device (19) located beside the first work top which works in conjunction with the needle to sew a stitch when the needle is in the lowermost position, when the needle pierces the leather articles;

means for reciprocating the rotary hook device and said needle so that said rotary hook device and needle are given a reciprocating longitudinal motion along the guide, a forward stroke moving the rotary hook device and needle towards the machine frame so as to move the leather articles forward.

2. Machine, according to claim 1, characterized in that said needle (14) is curved and mounted on an arm (13) that is equal in length to a radius of the needle curve, said arm being keyed onto a longitudinal shaft (12) which oscillates in rotation in such a manner as to define uppermost and lowermost positions for the needle, said needle piercing the juxtaposed edges **(30*a*,40*a*) of the articles (30,40)** when it is located in the lowermost position;

said shaft (12) being also given a reciprocating longitudinal motion with an outward and a return stroke, so as to move the said needle (14) accordingly.

3. Machine, according to claim 2, characterised in that a protection element (16) for needle protection is situated beside the second work top (P2), mounted rotatably on said shaft (12) and connected to the arm (13) by elastic means (22) so as to be pulled by the needle (14), during its downward movement, until it touches the edge (30) of the articles placed on the second work top (P2) and to remain in this position until the needle has left the edges of the articles (30,40) located on the work tops (P1,P2), and then, while going upwards, the needle picks it up by a stopping means (24) and brings it back to the raised position.

4. Machine, according to claim 1, characterized in that the said needle (25) is straight and reciprocates longitudinally so as to define two extreme positions, said needle (25) being also reciprocated with longitudinal outward and return stroke, so as to move the leather articles (30,40) accordingly.

5. Machine, according to claim 1, characterized in that it includes two presser feet **(15*a*,15*b*), located on opposite sides of the two work tops (P1,P2) and reciprocated according to opposite directions so as to press, in predetermined time, the edges (30*a*,40*a*) of the articles situated on the rear part of the work tops when the needle passes through and goes out of the leather articles (30,40)**.

6. Machine, according to claim 1, characterized in that the above mentioned hold down means (8,9) are fastened to a small fin (7) made integral with said guide (3), said hold down means including a blunted plate (8), arranged with the blunting facing the work top (P2), and a protrusion (9) of the fin (7) nearly parallel to the correspondent work top (P1).

7. Machine, according to claim 3, characterized in that the lower end of said protection element (16) features a hollow (17) through which the needle (14) passes.

8. Machine, according to claim 1 characterized in that the fixed support (1) includes an arm (2), extending from the machine support frame, and a prismatic element (4), that is fastened to the arm (2) with possibility to adjust its vertical position, said prismatic element (4) holding said guide (3) with possibility to adjust horizontal position of said guide (3).

* * * * *